US006332671B1

(12) United States Patent
Takahashi et al.

(10) Patent No.: US 6,332,671 B1
(45) Date of Patent: Dec. 25, 2001

(54) INK JET RECORDING HEAD AND METHOD OF MANUFACTURING THE SAME

(75) Inventors: Tomoaki Takahashi; Noriaki Okazawa; Ryoichi Tanaka, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/460,428

(22) Filed: Dec. 14, 1999

(30) Foreign Application Priority Data

Dec. 14, 1998 (JP) ..... 10-354628

(51) Int. Cl.[7] ..... B41J 2/45
(52) U.S. Cl. ..... 347/68; 347/70
(58) Field of Search ..... 347/68, 70, 71, 347/72, 94

(56) References Cited

U.S. PATENT DOCUMENTS 5,552,809 * 9/1996 Hosono et al. ..... 347/70
5,786,833 7/1998 Naka et al. ..... 347/71
5,818,482 10/1998 Ohta et al. ..... 347/70

FOREIGN PATENT DOCUMENTS 0 657 289 A2 6/1995 (EP) ..... B41J/2/14
0 819 523 A1 1/1998 (EP) ..... B41J/2/045

* cited by examiner

*Primary Examiner*—John Barlow
*Assistant Examiner*—Robert D Loper, Jr.
(74) *Attorney, Agent, or Firm*—Sughrue, Mion, Zinn, Macpeak & Seas, PLLC

(57) ABSTRACT

An ink jet recording head of the type in which a passage unit is formed as a layer structure made up of a passage forming plate and an elastic plate. The elastic plate is formed with a thick portion and a thin film portion. The thick portion bonded to the common ink chamber is used as a beam structure deformable toward the common ink chamber. The beam structure is deformed to create a flexure in a thin film sealing the common ink chamber.

21 Claims, 5 Drawing Sheets

INK JET RECORDING HEAD AND METHOD OF MANUFACTURING THE SAME

BACKGROUND OF THE INVENTION

The present invention relates to an ink jet recording head for forming an image on a recording medium by ejecting ink droplets on the recording medium. The present invention also relates to a method of manufacturing the ink jet recording head.

An ink jet recording head, which employs, for example, an piezoelectric elements as a pressure applying system, has a passage unit. The passage unit is formed by arranging a passage forming plate and an elastic plate in a layered manner on a nozzle plate having a plurality of nozzle orifices, and then the passage unit is fixed to or bonded to a case. The passage forming plate is formed with partition walls which define pressure generating chambers to be communicated with the respective nozzle orifices, a common ink chamber for storing ink to be supplied to the pressure generating chambers, ink supplying portions communicating the common ink chamber with the pressure generating chambers, and so on. The nozzle plate is bonded to one of the surfaces of the passage forming plate, while an elastic plate is bonded to the other surface of the same, thereby forming the passage unit. Piezoelectric elements are fixedly disposed on the case side so as to correspond in position to the respective pressure generating chambers. By attaching the passage unit to the case, each of the piezoelectric elements is brought into contact with and fixed to a corresponding part of the elastic plate where a corresponding one of the pressure generating chambers is disposed. The head thus constructed serves in the following manner: Ink is supplied from the common ink chamber to the pressure generating chambers. Each piezoelectric element, when driven, presses the elastic plate to increase pressure inside the corresponding pressure generating chamber, so that ink droplet is ejected from the corresponding nozzle orifice using the increased pressure.

The elastic plate is typically in the form of a two-layered structure made up of a high polymer film of 2 to 10 $\mu$m, such as a PPS (polyphenylene sulfite) film or a polyimide film, and a stainless steel plate of several ten microns. By subjecting the blank of the two-layered structure to photo etching process, a portion of the stainless steel plate, which corresponds in location to the common ink chamber is removed, while portions of the stainless steel plate, corresponding in location to the piezoelectric elements remains. The remaining portions of the stainless steel plate serves as thick portions with which the respective piezoelectric elements are fixedly contacted. The reason why the portion of the stainless plate corresponding in position to the common ink chamber is removed to expose the high polymer film is to prevent cross talk possibly occurring between adjacent nozzles as well as to eliminate print density variation.

Increase of pressure within a pressure generating chamber by pressurizing action of a piezoelectric element causes not only an ejection of an ink droplet from a corresponding nozzle orifice, but also an ink jet flow (i.e. a reverse flow) from the pressure generating chamber through the ink supplying portion to the common ink chamber. Consequently, pressure variation occurs within the common ink chamber to influence internal pressure of an adjacent pressure generating chamber, thereby varying ejection characteristic of an adjacent nozzle. In order to avoid such cross talk, a high polymer film serving as an elastic film is used to seal the common ink chamber (that is, the common ink chamber is at least partially defined by the elastic high polymer film) to increase compliance of the common ink chamber. This arrangement can absorb a pressure variation occurring within the common ink chamber due to the above-mentioned ink jet flow.

When the number of ejecting nozzles and the ejection frequency abruptly vary, a flow rate of the ink also abruptly varies. Therefore, a pressure wave is generated within the ink supplying portion by the water hammer action. This pressure wave also propagates from the common ink chamber to the pressure generating chambers via the ink supplying portion to affect the ejection characteristics of the nozzles. That is, variation of print density occurs depending on frequency cycle of the pressure wave. Therefore, in order to stabilize the print density, the high polymer film is used to seal the common ink chamber to increase the compliance of the common ink chamber, thereby absorbing a pressure variation within the common ink chamber due to the pressure wave, and coping with the variation of the ink flow rate.

It is, however, found out that in practice the ink jet recording head needs more compliance of the common ink chamber to completely prevent the cross talk and the print density variation.

The high polymer film of PPS or the like, rather than a metal plate, is adopted as the elastic film because the high polymer material can make the elastic film thinner in easier fashion and provide more compliance. However, a linear expansion coefficient of the high polymer film is larger than that of the silicon wafer constituting the passage forming plate or the stainless plate forming the thick portion of the elastic plate. Therefore, a tension acts on the high polymer film if temperature drops to room temperature after the postbaking is carried out to follow the dry film development during the photo etching process or after the passage forming plate is bonded to the elastic plate at high temperature. Further, most of high polymer films have such a nature that the high polymer films do not return to the original size once the high polymer films shrink at a predetermined temperature or higher. It is estimated that those characteristics or natures of the high polymer film causes a tension acting and remaining on the high polymer film after the high polymer film is bonded, which decreases the compliance to cause the cross talk and the print density variation. For this reason, it is considered that to secure a predetermined compliance, it is necessary to increase the size of the common ink chamber.

The size increase of the common ink chamber leads to increase of the head size. This is problematic in increasing the recording speed and reducing the entire size of a recording apparatus. Particularly in the case of the head having a multiple of nozzle arrays, which correspond to colors for color print, the size of the whole head depends largely on the width of the common ink chamber. In this respect, the size increase of the common ink chamber is not preferable.

More specifically, the manufacturing process for the passage unit, which includes a bonding step, includes a step or steps requiring temperature of 100° C. or higher. In this case, the high polymer film shrinks about 1%.

The experiment and analysis, conducted by the inventors, showed the following facts. To prevent the print density variation, it is necessary that a maximum tolerable pressure within the common ink chamber is 2000 Pa or lower. The evaluation was conducted using a compliance of the common ink chamber at 2000 Pa as the reference. At 2000 pa, a compliance obtained in an assumed condition where no 1% shrinkage of the high polymer film is caused is about 16 times as large as a compliance value obtained when the 1% shrinkage is caused. Conversely, to secure a 16-fold compliance in a state that the high polymer film is shrunk by 1%, the width of the common ink chamber must be increased approximately 2.5 times since the compliance is approximately proportional to the third power or cube of the width of the common ink chamber.

SUMMARY OF THE INVENTION

Accordingly, an object of the present invention is to provide an ink jet recording head which can increase a compliance of the common ink chamber without changing the size of the common ink chamber, and is capable of preventing cross talk between the adjacent nozzles and further a variation of print density.

The present invention provides the followings:

(1) An ink jet recording head comprising:

a passage forming plate including a plurality of pressure chambers which communicate with respective nozzle orifices and which are arrayed with a partition wall disposed between adjacent two of said pressure chambers, and a common ink chamber which communicates with a plurality of ink supplying portions each communicating with at least one end of a corresponding one of said pressure chambers;

an elastic plate bonded to said passage forming plate; and a pressure generating system provided for each of said pressure chamber, wherein said elastic plate is formed with a thick portion and a thin film portion, a part of said thick portion is constructed as a beam structure, a part of said thin film portion is flexible.

(2) The ink jet recording head according to (1), wherein said beam structure is deformable.

(3) The ink jet recording head according to (1) or (2), wherein said part of said thin film portion has flexure.

(4) The ink jet recording head according to any one of (1) to (3), wherein said pressure chambers are arrayed along a long side of said common ink chamber, and said part of said thick portion present is located opposite from said pressure chambers with respect to said common ink chamber.

(5) The ink jet recording head according to any one of (1) to (4), wherein said thin film portion is a high polymer film.

(6) The ink jet recording head according to any one of (1) to (5), wherein said thick portion of said elastic plate is metallic material.

(7) The ink jet recording head according to any one of (1) to (6), wherein said beam structure is partially elongated along a short side of said common ink chamber by forming a cutout portion in said elastic plate.

(8) The ink jet recording head according to any one of (1) to (7), wherein an elastic portion is formed in a part of said beam structure where it is elongated along the short side of said common ink chamber.

(9) The ink jet recording head according to any one of (1) to (8), wherein said passage forming plate further includes a plurality of said pressure chambers which communicate with respective second nozzle orifices and which are arrayed along a. second common ink chamber located adjacent to said first common ink chamber, and a slit is formed through a part of said elastic plate located between said adjacent first and second common ink chamber to locate said part of said thick portion between said slit and said first common ink chamber and to provide another part of said thick portion as a second beam structure between said slit and said second common ink chamber.

(10) The ink jet recording head according to any one of (1) to (9), wherein said pressure generating system includes a piezoelectric element.

(11) The ink jet recording head according to any one of (1) to (19), wherein said pressure generating system includes a heat generating element.

(12) A method of manufacturing an ink jet recording head comprising: a passage forming plate including a plurality of pressure chambers which communicate with respective nozzle orifices and which are arrayed with a partition wall disposed between adjacent two of said pressure chambers, and a common ink chamber which communicates with a plurality of ink supplying portions each communicating with at least one end of a corresponding one of said pressure chambers; an elastic plate bonded to said passage forming plate; and a pressure generating system, provided for each of said pressure chamber, for varying pressure within a corresponding one of said pressure chambers, said method comprising:

a laminating step of forming said elastic plate by laminating a high polymer film on a metal plate member; and a photo etching step, following said laminating process, of removing a portion of said metal plate member located correspondingly to at least said common ink chamber to provide a thin film portion formed of a high polymer film, while creating a long and narrow beam structure, which is deformable toward said common ink chamber, correspondingly to an outer edge portion of said common ink chamber using a thick portion formed of unremoved portion of said metal plate member and said high polymer film layered on said unremoved portion, wherein said beam structure is deformed using a contraction force of said high polymer film which is thermally contracted by a temperature variation in said photo etching process, to thereby deflect said thin film portion to be disposed correspondingly to said common ink chamber, and in this state said elastic plate is bonded to said passage forming plate.

(13) The method of manufacturing the ink jet recording head according to (12), further comprising:

a cutout portion forming step of forming a cutout portion through said elastic plate by punching said elastic plate so that said beam structure is partially elongated along a short side of said long and narrow common ink chamber.

(14) The method of manufacturing the ink jet recording head according to any one of (12) to (13), wherein said passage forming plate further includes a plurality of said pressure chambers which communicate with respective second nozzle orifices and which are arrayed along a second common ink chamber located adjacent to said first common ink chamber, and said method further comprising:

a slit forming step of forming a slit through a part of said elastic plate located between said adjacent first and second common ink chambers to locate said beam structure between said slit and said first common ink chamber and to provide a second beam structure of said thick portion between said slit and said second common ink chamber.

The present disclosure relates to the subject matter contained in Japanese patent application No. Hei. 10-354628 (filed on Dec. 12, 1998), which is expressly incorporated herein by reference in its entirety.

BRIEF DESCRIPTION OF THE DRAWINGS

FIG. 3 is an explanatory diagram showing common ink chambers, pressure generating chambers and the like.

DESCRIPTION OF THE PREFERRED EMBODIMENT

The preferred embodiments of the present invention will be described with reference to the accompanying drawings.

Figure 1:
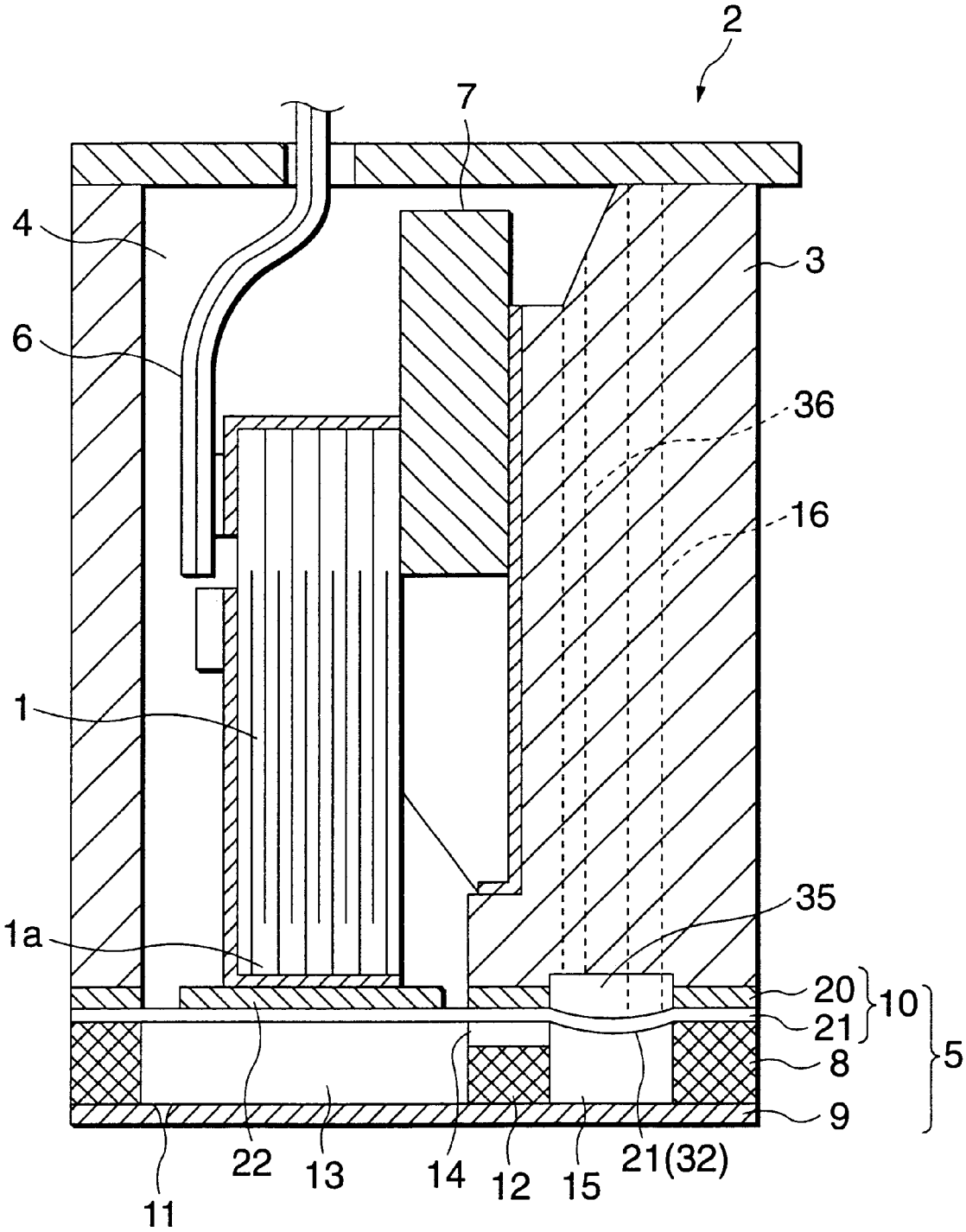
FIG. 1 is a cross sectional view showing an ink jet recording head.
Figure 2:
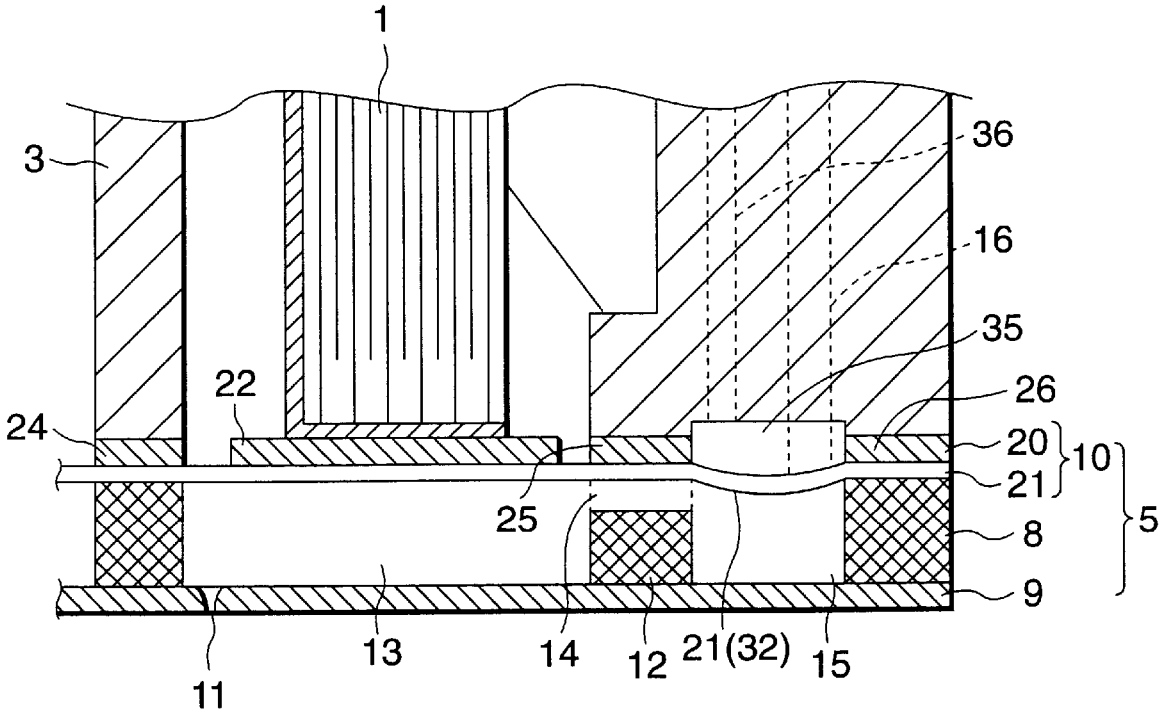
FIG. 2 is an enlarged sectional view showing a major portion of the head shown in FIG. 1.

FIG. 1 is a cross sectional view showing an ink jet recording head 2 (referred to as a head) in which electromechanical transducing elements 1, such as piezoelectric elements, are used as a pressure generating system. FIG. 2 is an enlarged cross sectional view showing a major portion of the head 2 shown in FIG. 1.

As shown in FIG. 1, the head 2 is generally constructed as follows. A pressure generating unit having the electromechanical transducing elements 1 arrayed like a comb is inserted into an accommodating space 4 of a box-like case 3, which is made for instance of plastic, through one (first opening) of the openings of the case 3 until the ends 1*a* of the electromechanical transducing elements 1 are located at the other (second opening) of the openings of the case 3. A passage unit 5 is fixed to or bonded to the surface (lower surface) of the side of the case 3 where the second opening is formed. The comb-like ends 1*a* of the electromechanical transducing elements 1 are respectively brought into contact with and fixed to predetermined portions of the passage unit 5. In the figure, reference numeral 6 is a flexible cable, and numeral 7 is a fixing base of the pressure generating unit.

The passage unit 5 has such a structure that a passage forming plate 8 is sandwiched by a nozzle plate 9 and an elastic plate 10 in a layered form.

The nozzle plate 9 is in the form of a plate having a plurality of nozzle orifices 11 formed therein, which are linearly arrayed at pitches corresponding to a dot density. In the present embodiment, two linear arrays of nozzle orifices 11 are formed in the nozzle plate 9.

Figure 3:
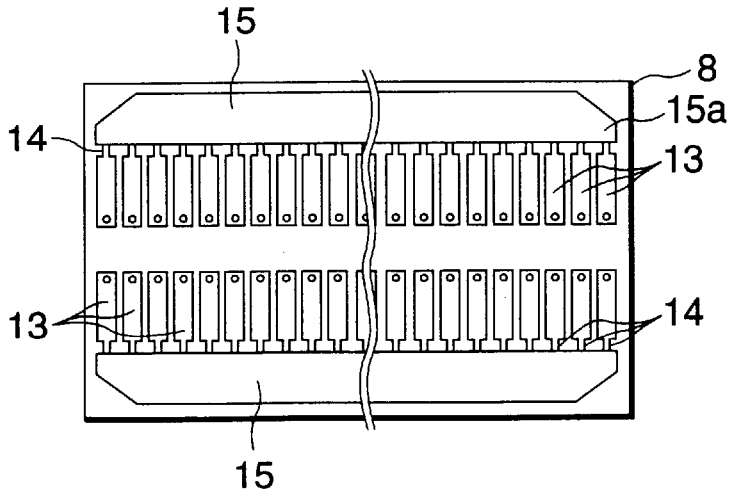

The passage forming plate 8 to be layered on one surface of the nozzle plate 9 includes a plurality of pressure chambers 13 and at least one long and narrow common ink chamber 15. The pressure chambers 13 communicate with the respective nozzle orifices 11, and are linearly arrayed with adjacent pressure chambers 13 being separated by a partitioning wall 12. In the present embodiment, two linear arrays of the pressure chambers 13 are provided whereas two common ink chambers 15 are provided for respective arrays as shown in FIG. 3. The common ink chambers 15 communicate through a plurality of ink supplying portions 14 each, in turn, communicating with at least one end of a corresponding one of the pressure chambers 13. In the embodiment, a silicon wafer is subjected to etching process to form the passage forming plate 8 that includes: a pair of the long and narrow common ink chambers 15 separated at a predetermined distance; two arrays of the pressure chambers 13 each array of which is elongated in a longer side of a corresponding one of the common ink chambers 15 so that the pressure chambers 13 are located depending on pitches of the arrayed nozzle orifices 11; and the ink supplying portions 14, each in the form of a groove extending between the associated common ink chamber 15 and the corresponding pressure chamber 13. The pressure chamber 13 is connected at its one end to the ink supplying portion 14, whereas the nozzle orifice 11 is located at a position in the vicinity of the other, opposite end of the pressure chambers 13. Each of the common ink chambers 15 serves to supply ink stored in an ink cartridge into the pressure chambers 13, and communicates at its substantially longitudinal center with an ink supplying pipe 16.

The elastic plate 10, in the embodiment, is designed to commonly serves as a sealing plate which is to be attached to the surface of the passage forming plate 8 opposite from the nozzle plate 9 to seal at least one opening of each pressure chamber 13 and an elastic film (thin film 21) which is to be attached to the same surface of the passage forming plate 8 but offset from the sealing plate to seal at least one opening of each common ink chamber 15. The elastic plate 10 is in the form of a two-layer structure made up of a stainless steel plate 20 and a high polymer film of PPS or the like laminated as an elastic film 21 on the stainless plate 20. To integrally form the sealing plate and the elastic film by the single elastic plate 10, the blank of the two-layer structure is subjected to the etching process. That is, a portion of the stainless plate 20 functioning as the sealing plate, i.e., a portion corresponding to the pressure chambers 13, is etched so that thick portions (islands 22) remains to receive the electromechanical transducing elements 1, whereas a portion of the stainless plate 20, which functions as the elastic film 21, i.e., a portion corresponding to the common ink chamber 15 (common-ink-chamber corresponding portion) is removed by photo etching process to expose the elastic film 21.

A structure of the elastic plate 10 as well as a method of manufacturing the same will be described in detail.

Figure 4:
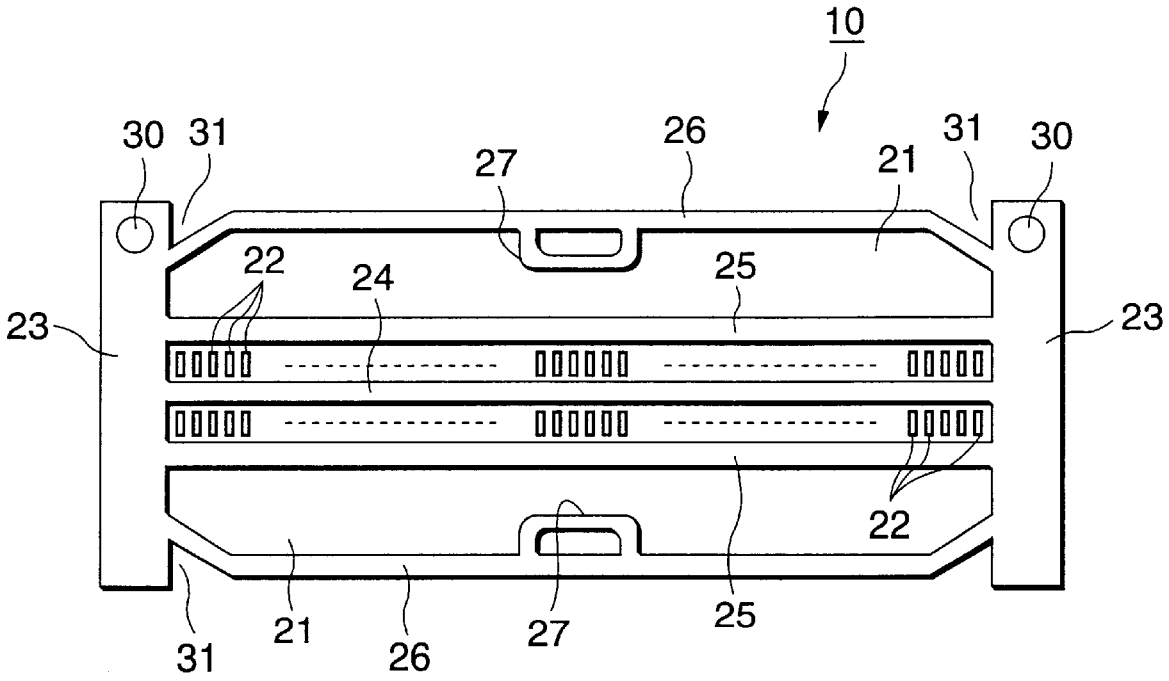
FIG. 4 is a plan view showing an elastic plate adapted to two linear arrays of nozzle orifices, which is formed with cutout portions, and beam structures uniform in width over their entire length.

The elastic plate 10 to be bonded to the passage forming plate 8 in which two linear arrays of pressure chambers 13 are formed is basically constructed as shown in a plan view of FIG. 4. Short side portions 23, i.e. thick portions, extend as the shorter side portions of the generally rectangular elastic plate 10. A central band portion 24, i.e. a thick portion, extends to connect a central portion of one short side portion 23 to a central portion of the other short side portion 23. Side band portions 25 are disposed on respective opposite sides with respect to the central band portion 24 to extend in parallel to the central band portion 24 and to connect both the short side portions 23. A space between the central band portion 24 and each of the side band portions 25 is equal in length to the longer side of each of the pressure chambers 13. Islands 22, i.e. thick portions, are formed between the central band portion 24 and each of the side band portions 25 to correspond to the respective pressure chambers 13. Beam structures 26, i.e. thick portions, extend as the longer side portions of the generally rectangular elastic plate 10 to connect vicinities of the ends of the short side portions 23 as shown. Annular ink supplying tube connectors 27 are provided at the substantially central portions of the beam structures 26 to protrude inwardly toward the central band portion 24.

When the elastic plate 10 is bonded to the passage forming plate 8, each of the side band portions 25 is bonded to the inner edge portion of the corresponding common ink chamber 15, i.e. a portion located between the pressure chambers 13 and the corresponding common ink chamber 15 and the pressure chambers 12 associated therewith. Each of the beam structures 26 is bonded to the outer edge portion of the corresponding common ink chamber 15, i.e. a portion opposite from the pressure chambers 13 with respect to the common ink chambers 15. The short side portions 23 are respectively bonded to the side edge portions of the common ink chambers 15. Accordingly, an area surrounded by the side band portion 25, the beam structure 26, and the short side portions 23 is a common-ink-chamber corresponding portion formed by the thin film portion (elastic film 21) closing the upper opening of the common ink chamber 15.

An area surrounded by the central band portion 24, the side and portion 25 and the right and left short side portions 23 serves as a sealing plate for sealing one of the opened surfaces of each pressure chambers 13. Islands 22 are formed as thick portions on the sealing plate, while a portion of the sealing plate surrounding the islands 22 is formed by a thin film portion (elastic film 21).

Areas surrounded by the ink supplying tube connectors 27 and positioning holes 30 located at the ends of the short side portions 23 are perforated as through-holes with a press work machinery.

To manufacture the elastic plate 10, a laminating process is carried out to laminate a PPS film as a high polymer film on the stainless plate 20, which is followed by a photo etching process. The photo etching process removes the unnecessary portions of the stainless plate 20 such as the common-ink-chamber corresponding portions, while leaving the thick portions of the short side portions 23, the portions 24 and 25, the beam structures 26, the islands 22 and the like. This photo etching process will be described hereunder.

In the photo etching process following the laminating process, a dry film as photo resist is laminated on the blank of the two-layered structure, and is subjected to an exposure process, a developing process, and a postbaking process. As a result, a pattern distinguishing portions removed by etching from portions remaining after the etching is created on the blank. Thereafter, the blank is subjected to an etching process. As a consequence of the etching process, the portions of the stainless plate 20 corresponding to the unnecessary portions thus distinguished by the pattern are dissolved by solvent to be removed. Therefore, only the PPS film is left in those portions and serve as thin film portion (elastic film 21), and the portions left or not dissolved serve as thick portions including the stainless plate 20. In this manner, the short side portions 23, the band portions 24 and 25, the beam structures 26, the islands 22 and the ink supplying tube connectors 27 are formed as thick portions, while only the PPS film is left in the areas around the islands 22 and in the common-ink-chamber corresponding portions. Thus, the thick portions of the elastic plate 10 are formed by patterning the stainless plate 20 made of metallic material.

Figure 5:
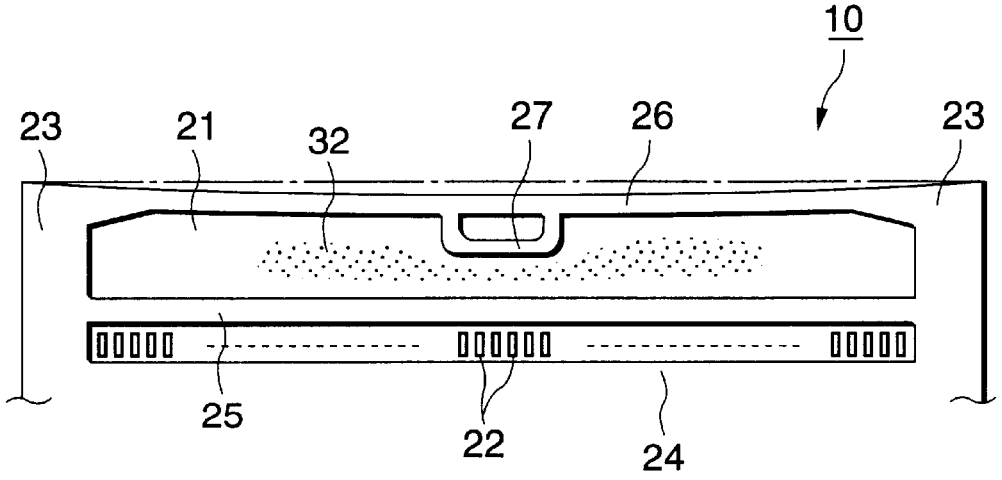
FIG. 5 is a plan view showing a part of another elastic plate in a state where a beam structure is deformed.

In the postbaking process, temperature rises to approximately 100° C. or higher, and thereafter it is cooled down to room temperature. With the cooling, the PPS film 21 thermally contracts to generate a tension therein. The beam structure 26 is long and narrow and has such a rigidity as to permit the beam structure 26 to deform toward the corresponding common ink chamber 15. Therefore, as indicated by a solid line in FIG. 5, the tension thus generated in the PPS film bends each of the beam structures 26 arcuately toward the corresponding common ink chamber 15 (in the direction of the plane of the elastic plate 10) when the beam structures 26 are formed. In the instance of FIG. 5, since the ends of the short side portions 23 are linearly interconnected, triangular widened portions are formed at the connecting portions of the beam structure 26 to the short side portions 23 so as to correspond to chamfering corner portions of the common ink chamber 15. The provision of the triangular widened portions increases the rigidity, which may hinder the bending of the beam structures 26.

Figure 6:
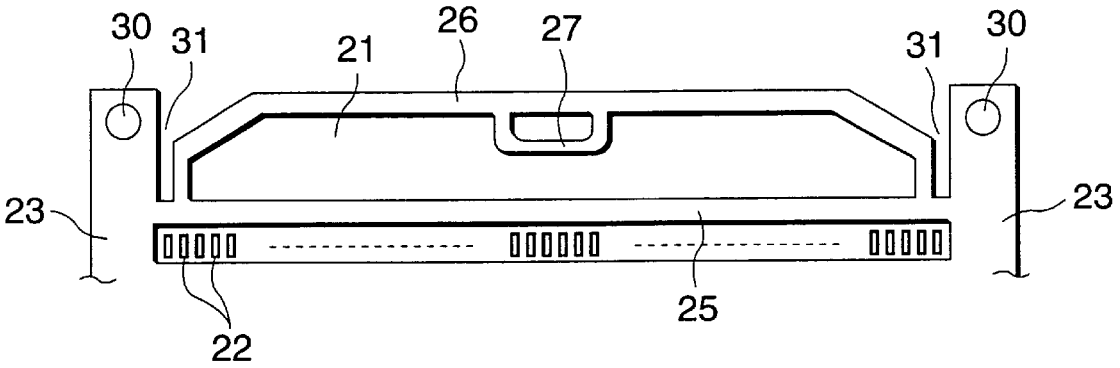
FIG. 6 is a plan view showing a part of another elastic plate in which cutout portions is formed to extend deeply to a side band portion.

Therefore, it is preferable, as shown in FIG. 4, that cutout portions 31 triangular in shape are formed at the widened portions to make the width of the beam structure 26 uniform over its entire length and partially form the shorter sides of the long and narrow common-ink-chamber corresponding portion by the beam structure 26. This design can facilitate the bending of the beam structure 26. The shape of the cutout portion 31 is not limited to the triangle. For example, as shown in FIG. 6, the cutout portion 31 may be shaped to extend inwardly from an imaginary corner of the triangle (to the side band portion 25 so as to form the entire shorter side of the long and narrow common-ink-chamber corresponding portion by the beam structure 26). In short, the beam structure 26 effectively functions if the beam structure 26 are formed at the outer edge portion of the common ink chamber 15 except the long side 15a of the common ink chamber 15 close to the pressure chambers 13.

When the long and narrow beam structure 26 is bent toward the common ink chamber 15, a quantity of deformation (displacement) of the beam structure 26 is small at the longitudinal ends of the PPS film 21, and hence a tension is still present there. On the other hand, in the remaining portion of the PPS film 21, in particular the central portion thereof, the tension is removed or released, and further the deformation (displacement quantity) of the beam structure 26 at that portion exceeds the quantity of the contraction of the PPS film 21 because of the tension left on the PPS film 21 around that portion. Consequently, a flexure of the PPS film 21 occurs in that portion. Even if the beam structure 26 is deformed in the width direction of the common ink chamber 15 to release the tension of the PPS film 21 in the same width direction, the release of the tension of the PPS film 21 in the longitudinal direction of the common ink chamber 15 is small. Therefore, a flexure 32 appears as a stripe in the central portion of the PPS film 21 as shown in FIG. 5.

Figure 7:
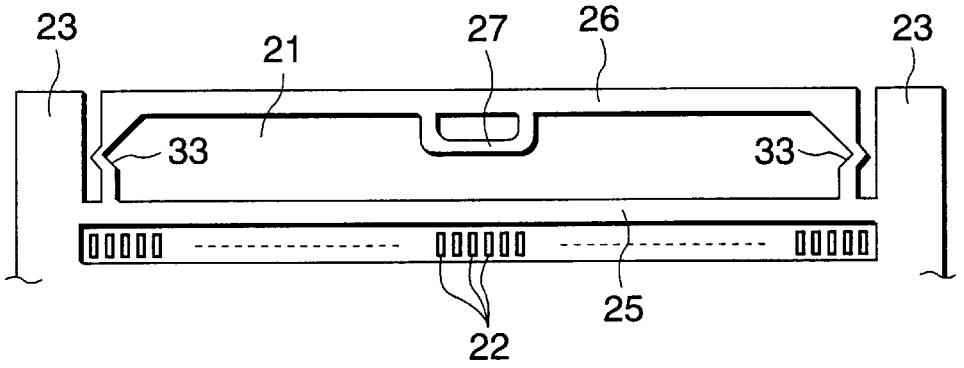
FIG. 7 is a plan view showing a part of another elastic plate in which soft elastic portions are formed at locations of the beam structure, which correspond to the short sides of the common ink chamber.

As shown in FIG. 7, soft elastic portions 33, which are more deformable than other portions, maybe formed on the beam structure 26 to be located at the shorter sides of the common ink chamber 15. Those soft elastic portions 33 are deformed at greater quantity than the other or remaining portions, and facilitate the formation of a greater flexure of the PPS film 21. It is preferable to form the soft elastic portions 33 to be narrower than the remaining portions. Each of the elastic portions 33 may be bent to protrude outwardly on the same plane as illustrated, or inwardly on the same plane, or may be in the form of a zigzag shape on the same plane.

The beam structure 26 is bonded to the outer edge portion of the common ink chamber 15. Accordingly, the beam structure 26 receives only a tension directed to the common ink chamber 15, and thus the beam structure 26 is deformed toward the common ink chamber 15. In contrast, the side band portion 25, which is located on the opposite side from the beam structure 26 with respect to the common ink chamber 15, receives a tension from the common ink chamber 15 and a tension from the pressure chambers 13, which are cancelled with each other. Therefore, the side band portion 25 is not deformed as the beam structure 26 are done. For this reason, the islands 22 are not displaced to such a degree as to cause a problem.

After the photo etching process ends, the through-holes of the ink supplying tube connectors 27 and the positioning holes 30 are formed by punching process. The punching process may be carried out concurrently with the cutting-out process for forming the cutout portions 31.

Thus, in the invention, the beam structure 26 is employed to release the tension caused on the thin film 21. Further, the beam structure 26 is deformed toward the common ink chamber 15 using a thermal contraction of the high polymer film during the fabrication of the elastic plate 10, to thereby provide a flexure of the high polymer film (thin film 21) in the common-ink-chamber corresponding portion. That is, any special process is required to provide the flexure of the high polymer film (thin film 21).

In a case where the passage unit 5 is formed by stacking the thus formed elastic plate 10, the passage forming plate 8 and the nozzle plate 9 one on another, the nozzle plate 9 is fixed to or bonded to one of the surfaces of the passage forming plate 8 so that smaller open ends of the nozzle orifices 11 are directed outwardly, whereas the elastic plate 10 is fixed to or bonded to the other surface of the passage forming plate 8 so that the stainless plate 20 of the elastic plate 10 is located opposite from the passage forming plate 8 with respect to the thin film 21. In this manner, the passage forming plate 8 is sandwiched between the nozzle plate 9 and the elastic plate 10 so that the openings of the pressure chambers 13 and the common ink chambers 15 on one side of the passage forming plate 8 are sealed with the elastic film 21, the upper openings of the groove-like ink supplying portions 14 are covered with the elastic film 21, and the openings of the pressure chambers 13 and the common ink chambers 15 on the other side of the elastic plate 10 are closed with the nozzle plate 9.

If the passage unit 5 thus assembled is heated in the bonding process, and if its temperature is thereafter returned to room temperature, there is little chance of reducing a compliance of the elastic film 21 since the elastic film (thin film 21) is previously deflected. The larger compliance of the thin film 21 sealing the common ink chambers 15 makes it possible to sufficiently absorb a pressure variation in the common ink chambers 15. This leads to suppression of cross talk generation and stabilization of print density. Our experiment shows that the compliance of the thin film 21 is sufficiently large since the beam structures 26 are each deformed 1 to 10$\mu$m in the longitudinally central portion thereof.

As shown in FIGS. 1 and 2, a recess 35 is formed at a location corresponding to each of the common ink chambers 15 on the surface of the case 3 to which the passage unit 5 is bonded. With the provision of the recess 35, a portion of the elastic film (thin film 21) where the flexure 32 is present is put in an unfixed state with respect to the case 3. This recess 35 functions as a space permitting the thin film 21 to deform and move for expansion. In a case where the recess 35 is closed, air confined within the recess 35 is compressed or expanded during deformation of the thin film 21, so that the air within the depression 35 also serves to provide a compliance. Note, however, that the compliance of the thin film 21 and the compliance of the air within the recess 35 are arranged in series so that the total compliance may not so large. Therefore, it is preferable to provide a through-hole 36 connecting the recess 35 to the outside of the case 3 since the provision of such through-hole 36 makes the compliance of the air within the recess 35 infinite, so that the compliance of the thin film 21 can be effectively and fully utilized.

Figure 8:
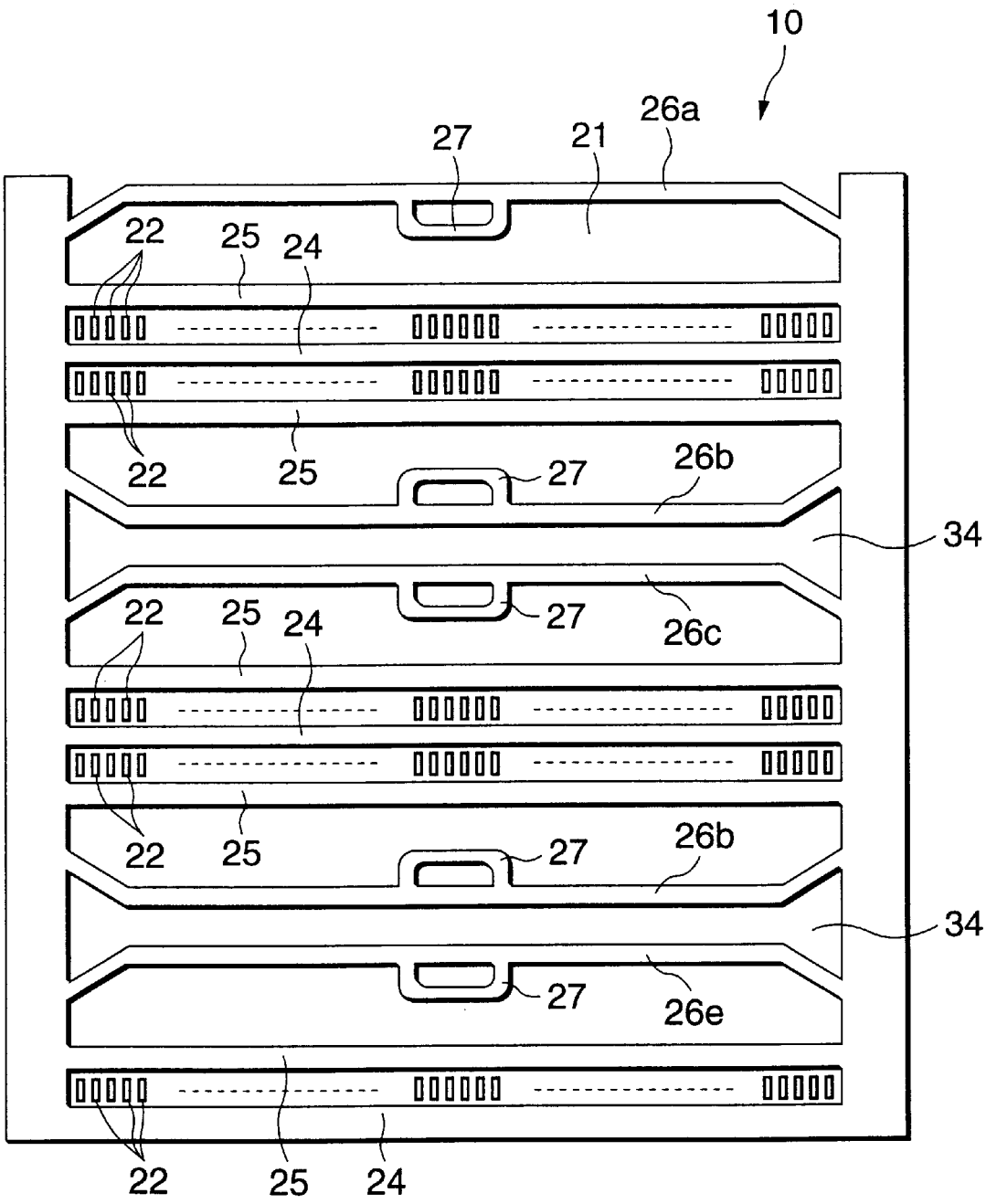
FIG. 8 is a plan view showing another elastic plate adapted to five linear arrays of nozzle orifices, in which common ink chambers are arranged in back-to-back fashion, and a slit is formed between the adjacent common ink chambers.

An elastic plate 10 shown in FIG. 8 is adapted to an arrangement in which five linear arrays of nozzle orifices 11 are provided, a plurality of pressure chambers 13 are arrayed to correspond to the five nozzle-orifice arrays, and narrow and long common ink chambers 15 are disposed side by side and along those linear arrays of the pressure chambers 13. A first common ink chamber 15 for supplying ink to a first nozzle linear array is opened at its outer edge portion (that is, the first nozzle linear array is disposed adjacent to one side of the first common ink chamber but no chamber or no member need not be disposed on the other side (the outer edge portion side) of the first common ink chamber). Therefore, a first beam structure 26*a* can be formed on the elastic plate 10 similarly to the aforementioned embodiments. Second, third, fourth and fifth common ink chambers 15 respectively for supplying ink to second, third, fourth and fifth nozzle linear arrays are not opened at their outer edge portions since each of the those common ink chambers 15 is disposed between the associated pressure chamber (13) array and another of those common ink chamber 15.

To cope with this, a slit 34 is formed through the elastic plate 10 between the adjacent common ink chambers 15 to extend in the linear array direction. In this embodiment, two slits 34 are formed, one defining second and third beam structures 26*b* and 26*c* of thick portions located respectively between the one slit 34 and the second and third common ink chambers 15 and the other defining fourth and fifth beam structures 26*d* and 26*e* of thick portions located respectively between the other slit 34 and the fourth and fifth common ink chambers 15. In short, a slit 34 is formed in the outer edge portion of the common ink chamber 15 to open the outer edge portion thereof (to contour the edge of the common ink chamber 15), thereby forming a long and narrow beam structure 26 deformable toward the common ink chamber 15. It is essential that the slit 34 passes through the elastic plate 10, i.e. not only the stainless plate 20 but also the thin film portion 21 must be removed to form the slit 34. Therefore, to form the slit 34, the elastic plate 8 is subjected to the punching process (slit punching process). In order that the width of each beam structure 26 is made uniform over its length, both ends of the each slit 34 is widened as shown in FIG. 8. The slit punching process may be carried out simultaneously with the cutout portions (31) punching process.

The beam structures 26*a*, 26*b*, 26*c*, 26*d* and 26*e* are formed corresponding to the common ink chambers 15, the beam structures 26*a*, 26*b*, 26*c*, 26*d* and 26*e* serve to release the tension caused on the thin film 21 similarly to the aforementioned embodiments. Further, the contraction of the thin film 21 made of the high polymer film is utilized to deform the beam structures 26 toward the corresponding common ink chambers 15, thereby providing flexures 32 in the thin film 21. Accordingly, the compliance of the thin film 21 at each of the common ink chambers 15 is increased to sufficiently absorb a pressure variation in each of the common ink chambers 15. Therefore, cross talk generation is suppressed and print density is stabilized.

While the electromechanical transducing elements 1 are used as a pressure generating system in the ink jet recording head 2 mentioned above, those may be substituted by any other suitable system, such as heat generating elements (not shown) which apply heat to ink within the pressure chambers 13 so that pressure caused by air bubbles generated from the ink is utilized to eject ink.

As described above, the present invention produces the following useful effect.

The beam structure is formed to correspond to the common ink chamber. This arrangement makes it possible to release the tension caused on the thin film.

The thin film portion for sealing the common ink chamber is deflected. Therefore, the compliance of the common ink chamber can be increased without changing the size of the common ink chamber. It is possible to reliably prevent the cross talk generation and to reliably stabilize the print density.

Further, the thin film portion can be deflected using the shrinkage or contraction of the thin film portion per se. This leads to easy manufacturing.

The pressure chambers are linearly arrayed along the long side of the common ink chamber, and the thick portion present at a location opposite from the pressure chambers is used as the beam structure. Therefore, a flexure is easy to be created in the thin film portion.

The thin film portion is made up of a high polymer film. Therefore, it is easy to shrink and easy to be deflected.

The thick portion of the elastic plate is formed by patterning metallic material. Fine fabrication can be made with high precision, and the manufacturing is easy.

The beam structure is extended to the short sides of said common ink chamber by forming cutout portions in the elastic plate. Therefore, this arrangement facilitates the deformation of the beam structure to create the flexure of the thin film portion.

The elastic portion is formed in a portion of the beam structure, where it is located at the short side of the common ink chamber. Accordingly, the thin film portion is more easily deflected.

A slit is formed between the adjacent common ink chambers. Therefore, even if the common ink chambers are disposed back to back, the beam structure can be formed surely for each of the adjacent common ink chambers regardless of the presence of a large number of nozzle orifices for each of the adjacent common ink chambers.

Regardless of whether the pressure generating system is constructed by piezoelectric elements or heating elements, it is possible to prevent the cross talk and stabilize the print density while fully utilizing the characteristic of the pressure generating system.

The cutout portion and the slit are formed by the punching process. Therefore, high precision, mass production is possible, and the production efficiency is improved.

What is claimed is:

1. An ink jet recording head comprising:

a passage forming plate including a plurality of pressure chambers which communicate with respective nozzle orifices and which are arrayed with a partition wall disposed between adjacent two of said pressure chambers, and a common ink chamber which communicates with a plurality of ink supplying portions each communicating with at least one end of a corresponding one of said pressure chambers;

an elastic plate bonded to said passage forming plate; and a pressure generating system provided for each of said pressure chamber, wherein said elastic plate is formed with a thick portion and a thin film portion, a part of said thick portion is constructed as a beam structure, a part of said thin film portion is flexible.

2. The ink jet recording head according to claim 1, wherein said beam structure is deformable.

3. The ink jet recording head according to claim 1, wherein said part of said thin film portion has flexure.

4. The ink jet recording head according to claim 1, wherein said pressure chambers are arrayed along a long side of said common ink chamber, and said part of said thick portion present is located opposite from said pressure chambers with respect to said common ink chamber.

5. The ink jet recording head according to claim 1, wherein said thin film portion is a high polymer film.

6. The ink jet recording head according to claim 1, wherein said thick portion of said elastic plate is metallic material.

7. The ink jet recording head according to claim 1, wherein said beam structure is partially elongated along a short side of said common ink chamber by forming a cutout portion in said elastic plate.

8. The ink jet recording head according to claim 7, wherein an elastic portion is formed in a part of said beam structure where it is elongated along the short side of said common ink chamber.

9. The ink jet recording head according to claim 7, wherein a part of the beam structure adjacent to the cutout portion is lower in rigidity than a part of the beam structure not adjacent to the cutout portion.

10. The ink jet recording head according to claim 1, wherein said passage forming plate further includes a plurality of said pressure chambers which communicate with respective second nozzle orifices and which are arrayed along a second common ink chamber located adjacent to said first common ink chamber, and a slit is formed through a part of said elastic plate located between said adjacent first and second common ink chamber to locate said part of said thick portion between said slit and said first common ink chamber and to provide another part of said thick portion as a second beam structure between said slit and said second common ink chamber.

11. The ink jet recording head according to claim 1, wherein said pressure generating system includes a piezoelectric element.

12. The ink jet recording head according to claim 1, wherein said pressure generating system includes a heat generating element.

13. A method of manufacturing an ink jet recording head comprising: a passage forming plate including a plurality of pressure chambers which communicate with respective nozzle orifices and which are arrayed with a partition wall disposed between adjacent two of said pressure chambers, and a common ink chamber which communicates with a plurality of ink supplying portions each communicating with at least one end of a corresponding one of said pressure chambers; an elastic plate bonded to said passage forming plate; and a pressure generating system, provided for each of said pressure chamber, for varying pressure within a corresponding one of said pressure chambers, said method comprising:

a laminating step of forming said elastic plate by laminating a high polymer film on a metal plate member; and a photo etching step, following said laminating process, of removing a portion of said metal plate member located correspondingly to at least said common ink chamber to provide a thin film portion formed of a high polymer film, while creating a long and narrow beam structure, which is deformable toward said common ink chamber, correspondingly to an outer edge portion of said common ink chamber using a thick portion formed of unremoved portion of said metal plate member and said high polymer film layered on said unremoved portion, wherein said beam structure is deformed using a contraction force of said high polymer film which is thermally contracted by a temperature variation in said photo etching process, to thereby deflect said thin film portion to be disposed correspondingly to said common ink chamber, and in this state said elastic plate is bonded to said passage forming plate.

14. The method of manufacturing the ink jet recording head according to claim 13, further comprising:

a cutout portion forming step of forming a cutout portion through said elastic plate by punching said elastic plate so that said beam structure is partially elongated along a short side of said long and narrow common ink chamber.

15. The method of manufacturing the ink jet recording head according to claim 13, wherein said passage forming plate further includes a plurality of said pressure chambers which communicate with respective second nozzle orifices and which are arrayed along a second common ink chamber located adjacent to said first common ink chamber, and said method further comprising:

a slit forming step of forming a slit through a part of said elastic plate located between said adjacent first and second common ink chambers to locate said beam structure between said slit and said first common ink chamber and to provide a second beam structure of said thick portion between said slit and said second common ink chamber.

16. A passage forming unit for an ink jet recording head, said unit comprising:

a passage forming plate which at least partially defines a plurality of arrayed pressure chambers communicating with respective nozzle orifices, and which at least partially defines a common ink chamber communicating through ink supplying portions with said pressure chambers;

an elastic plate fixed to said passage forming plate, said elastic plate having a side band portion, a beam structure portion and a thin film portion bounded at least by said side band portion and said beam structure portion, said thin film portion forming a deformable wall of said common ink chamber, said side band portion being located between said common ink chamber and said pressure chambers, wherein a rigidity of said beam structure portion is smaller than a rigidity of said side band portion.

17. The passage forming unit according to claim 16, wherein a width of said beam structure portion is equal to or smaller than a width of said side band portion.

18. The passage forming unit according to claim 16, wherein a width of said beam structure portion is uniform over its entire length.

19. The passage forming unit according to claim 18, wherein said beam structure portion has a first part substantially parallel to said side band portion, and second parts each obliquely extending from a corresponding end of said first part.

20. The passage forming unit according to claim 16, wherein said beam structure portion has a first part substantially parallel to said side band portion, and second parts each connecting a corresponding end of said first part to said side band portion.

21. The passage forming unit according to claim 16, further comprising:

a nozzle plate fixed to said passage forming plate, said nozzle plate having said nozzle orifices.

* * * * *